US006238292B1

(12) United States Patent
Pelkey

(10) Patent No.: US 6,238,292 B1
(45) **Date of Patent: *May 29, 2001**

(54) PUSH BUTTON CONTROLLED POLICE BATON WITH BALL BEARING LOCKING MECHANISM

(75) Inventor: Gary L. Pelkey, Rindge, NH (US)

(73) Assignee: Monadnock Lifetime Products, Inc., Fitzwilliam, NH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/085,699

(22) Filed: May 27, 1998

(51) Int. Cl.[7] ..... F41B 15/02
(52) U.S. Cl. ..... 463/47.7; 403/368
(58) Field of Search ..... 403/325, 350, 403/367, 368, 377; 085/302; 463/47.2, 47.7; 135/68–70, 72, 75

(56) References Cited

U.S. PATENT DOCUMENTS

| | | | | |
|---|---|---|---|---|
| D. 333,692 | | 3/1993 | Parsons | D22/117 |
| D. 333,693 | | 3/1993 | Parsons | D22/117 |
| 3,302,960 | * | 2/1967 | Herrmann . | |
| 3,469,871 | * | 9/1969 | Betts . | |
| 3,507,528 | * | 4/1970 | Desmarchais . | |
| 4,037,839 | | 7/1977 | Nelson | 273/84 |
| 5,110,375 | | 5/1992 | Parsons | 148/534 |
| 5,149,092 | | 9/1992 | Parsons | 273/84 |
| 5,161,800 | | 11/1992 | Parsons | 273/84 |
| 5,348,297 | | 9/1994 | Parsons | 273/84 |
| 5,356,139 | | 10/1994 | Parsons | 273/84 |
| 5,407,197 | | 4/1995 | Parsons | 273/84 |

FOREIGN PATENT DOCUMENTS

| | | |
|---|---|---|
| 9610632 | 5/1996 | (GB) . |
| 2 303 432 | 2/1997 | (GB) . |

* cited by examiner

*Primary Examiner*—William M. Pierce
(74) *Attorney, Agent, or Firm*—Ernest V. Linek; Banner & Witcoff, Ltd.

(57) ABSTRACT

An expandable police baton having tubular members, and positive ball bearing locking with an axially positioned cam release mechanism, which will maintain the members in an expanded telescoped position and then can release the locking mechanism by pushing a single button at the rear thereof so that the members can slide over one another to a collapsed position convenient for carrying the baton.

9 Claims, 3 Drawing Sheets

PUSH BUTTON CONTROLLED POLICE BATON WITH BALL BEARING LOCKING MECHANISM

BACKGROUND OF THE INVENTION

This invention relates to a new and improved multi-stage positive lock tubular expandable police baton. Police batons are used by police for crowd control and other police duties in place of the conventional wooden billy clubs. Expandable police batons are shown for example in U.S. Pat. Nos. 5,320,348 and 5,160,140.

SUMMARY OF THE INVENTION

The present invention provides a new and improved positive lock quick release police baton. In particular, the collapse of the extended sections into the larger tubular section is accomplished by the use of a single axially positioned push button mechanism which releases ball bearing locking mechanisms in the sections.

This invention discloses a positive lock button release police baton, preferably having three sections. Each section successively gets smaller in diameter with the smaller sections telescoping into and out of larger section in which they are slidably positioned.

In this baton, the middle section and the smaller inner section are moved outwardly until they are locked in place by locking means when each of the sections are fully extended. To cause the collapse of the sections into one another, a push button is depressed to cause an axially positioned release rod to disengage a first ball bearing locking means holding the middle section to permit it to telescope into the larger end section. While the middle section is telescoping into said larger diameter end section, a second ball bearing locking means holding the smaller section in place relative to said middle section is caused to disengage by the tip of the release rod so that the smaller end section may telescope into said middle section.

The baton may be made out of any metal such as steel, aluminum or any combination thereof. The preferred steel is an alloy steel such as 4130. The steel may be hardened if desired, for example to 38 to 44 as measured on the Rockwell C Scale, using conventional heat treating process which produce martensite or bainite steel. The preferred aluminum is 6061 or 7075.

BRIEF DESCRIPTION OF THE DRAWINGS

The foregoing and other features and advantages of the present invention will be more fully understood from the following detailed description of an illustrative embodiment, taken in conjunction with the accompanying drawing in which.

DETAILED DESCRIPTION OF THE PREFERRED EMBODIMENTS

Figure 1:
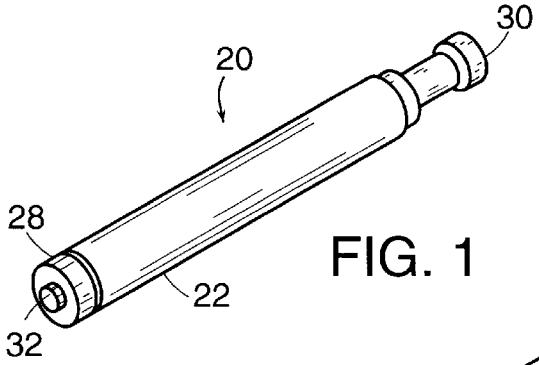
FIG. 1 is a perspective view showing the expandable police baton of this invention in a collapsed (closed) position.
Figure 2:
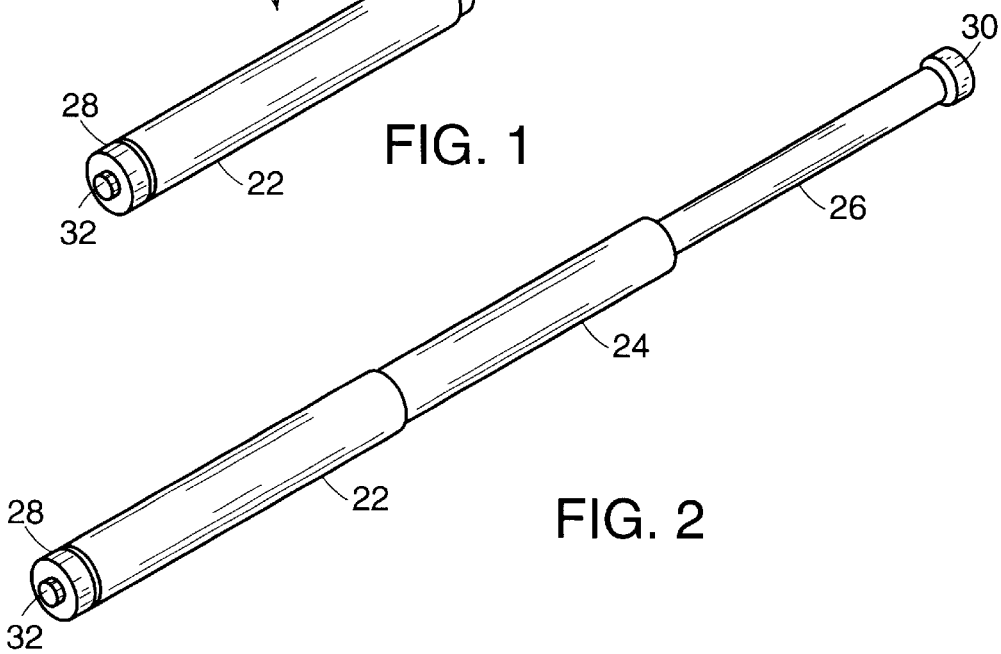
FIG. 2 is a perspective view of the police baton in an expanded (telescoping) position.

Reference now should be had to FIGS. 1 and 2 of the drawings.

FIG. 1 shows the baton in a collapsed condition and FIG. 2 shows the baton in a fully extended (telescoping) condition. The baton 20 has a first (outer) tubular handle section 22, a second (middle) tubular section 24 and a third (inner) tubular section 26. A rear cap is provided at 28, which is preferably threaded to handle section 22. A tip is provided at 30 which has a threaded shaft 30*a* (FIG. 3) for screwing into threads of the third tubular section 26. The tip 30 may be coated in an elastic or plastic material, such as rubber, Plastisol, or other similar materials well known in the art, in order to protect against unintended injury. A button 32 is provided at the base of the cap which is depressed by the user to permit the baton to collapse from the extended position as shown in FIG. 2 to the collapsed condition shown in FIG. 1.

Figure 3:
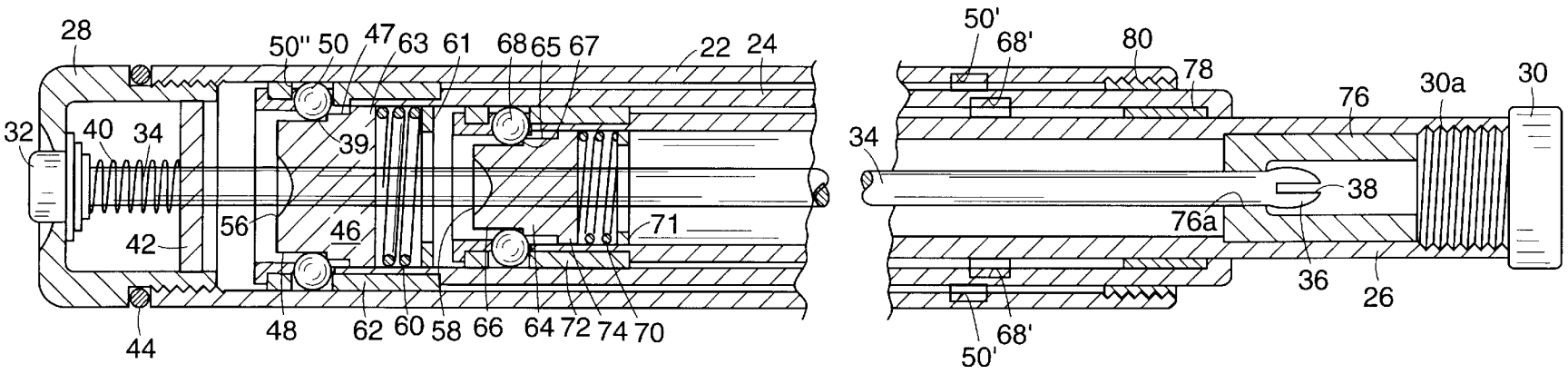
FIG. 3 is a sectional view (partially broken away) of the tubular police baton when in the collapsed position as shown in FIG. 1.

Reference should now be had to FIGS. 3 to 8 for a further description of the operation of the baton. FIG. 3 illustrates the first, second and third tubular sections in the collapsed position as shown in FIG. 1. As shown, the releasing rod 34 has a camming surface 36 and a notch 38. The notch 38 permits the camming surface to resiliently collapse radially. The release rod 34 is fixedly coupled to the button 32 for movement therewith and a spring 40 and a platform 42 fixedly supported by the rear cap 28 (e.g., by welding, threading, press fit or bonding etc.) causes the spring to be in compression to force the button 32 to project outwardly from the rear cap 28. An O-ring 44 is provided between the threaded rear cap 28 and the first tubular section 22 as shown.

Slidably disposed inside the middle tubular section 24 is a first locking cam member 46. The first locking cam is shaped with a large diameter portion 47, a reduced diameter portion 48, and a camming surface 49. The locking cam is provided with a center bore with a camming surface 56. The locking cam 46 bears against ball bearings 50 that are supported in a retainer holes 50". A spring 60 is used to urge the locking cam 46 toward the button end 32 of the baton. The middle tubular section 24 is fitted with a collar 62 that may be press fit, threaded, welded, bonding, peaned or swaged onto the end of the tubular middle section 24. A washer 61 may optionally be provided on a shoulder formed on the inside surface of the tubular middle section 24 to support the spring 60. The locking cam member 46 is further provided with a shoulder or flange 63 for retaining the cam against the ball bearings 50 when the locking cam 46 is fully extended.

Slidably disposed inside the third inner section 26 is a second locking cam member 64, which closely resemble the first locking cam member 46, except that it is smaller. The second locking cam is shaped with a large diameter portion 65, a reduced diameter portion 66, and a camming surface 67. The locking cam is provided with a center bore with a camming surface 58. The locking cam 64 bears against ball bearings 68, which are supported in retaining holes 68". A spring 70 is used to urge the locking cam 64 toward the button end 32 of the baton. The inner tubular section 26 is fitted with a collar 72 that may be press fit, threaded, welded, bonding, peaned or swaged onto the end of the tubular inner section 26. A washer 71 may optionally be provided on a shoulder formed on the inside surface of the tubular middle section 26 to support the spring 70. The locking cam member 64 is further provided with a shoulder or flange 74 for retaining the cam against the ball bearings 50 when the locking cam 64 is fully extended.

The threaded portion 30*a* of the tip 30 is adjacent to an insert 76 provided with a receiving space for the camming portion 36 of the release rod 34. A reduced diameter portion 76*a* of the insert 76 engages the rod 34 adjacent to the camming portion 36 maintains the baton in a collapsed configuration. A quick throw out (or wrist "flick") of the baton overcomes the hold back effect of this resistance, and also will allow the rod tip 36 to pass through the first and second locking cams 46, 64. If desired, a slow passive draw of the baton elements may also be employed. The notch 38 permits radial resilient collapsing of the camming portion 36 when passing through the locking cams and the threaded portion 30*a*.

Figure 4:
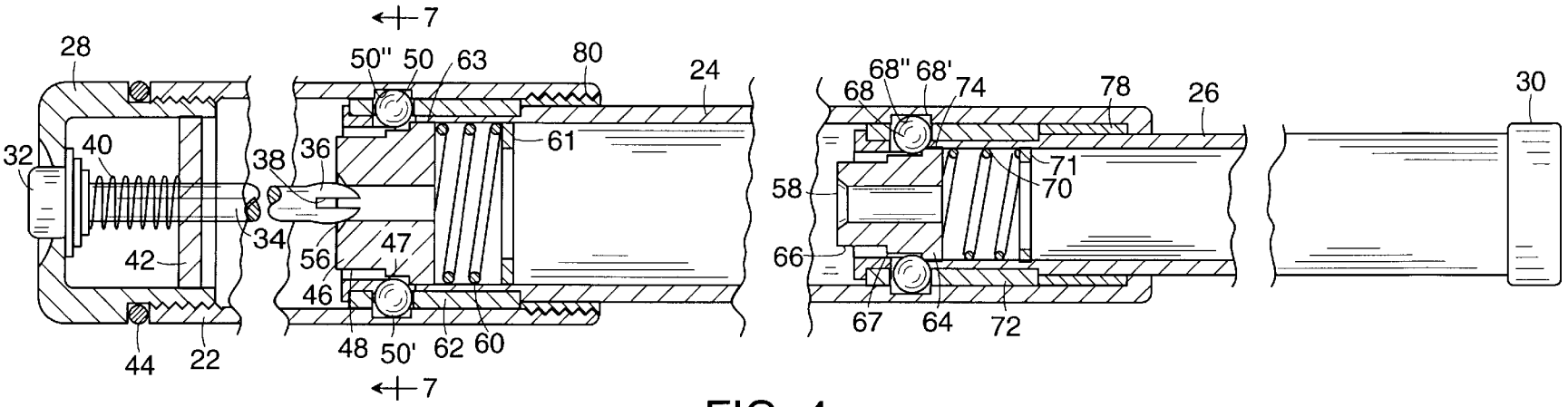
FIG. 4 is a sectional view (partially broken away) when the baton is in an expanded condition as shown in FIG. 2.

In FIG. 4, there is shown the baton in the fully telescoped (extended) position. In this position, the locking mechanism ball bearings 50 and 68 are shown positioned in place to positively lock the baton for use. The ball bearings 50 and 68 snap in place into grooves 50', 68' formed in the interiors of tubular members 22 and 24, respectively. Under the bias of the spring members 60, 70, the locking cam members 46, 64 are biased toward the button end 32 of the baton, such that the large diameter portions 47, 65 of the locking cam members 46, 64 maintain the ball bearings 50, 68 in their respective grooves 50', 68'.

The third tubular section 26 moves against a metal bushing 78 e.g., of metal e.g., 4130 or 1020 steel which can be either threaded in as with bushing 80 or force fit and then having the end of the tubular member 24 peaned over to hold it in place as shown. This bushing may be threaded, bonded or welded. The bushings can also have a slip fit outside diameter retained by rolling, swaging or crimping of the edge of the tubular members.

Figure 5:
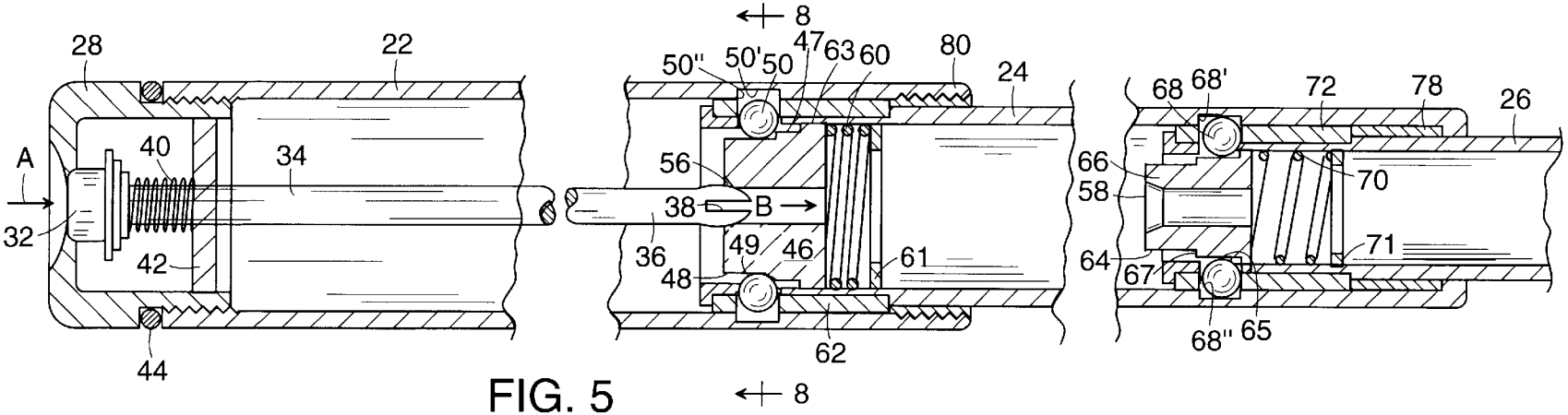
FIG. 5 is a sectional view (partially broken away) as the baton is being closed (collapsed) and the middle (intermediate) section moves into the larger tubular section.

FIG. 5 illustrates the collapsing of the baton and in particular, the button 32 being depressed in the direction of arrow A, which causes the camming surface 36 of the release rod 34 to engage the chamfered cam surface 56 of locking cam member 46 to force the cam member 46 forward in the direction of arrow B. This in turn moves the locking cam member 46 such that the reduced diameter portion 48 underlies the ball bearings 50, allowing them to disengage from the groove 50' formed in tubular member 22. In this way, the baton section 24 can collapse into the section 22 by being pushed by the user to the left as depicted in FIG. 5.

Figure 6:
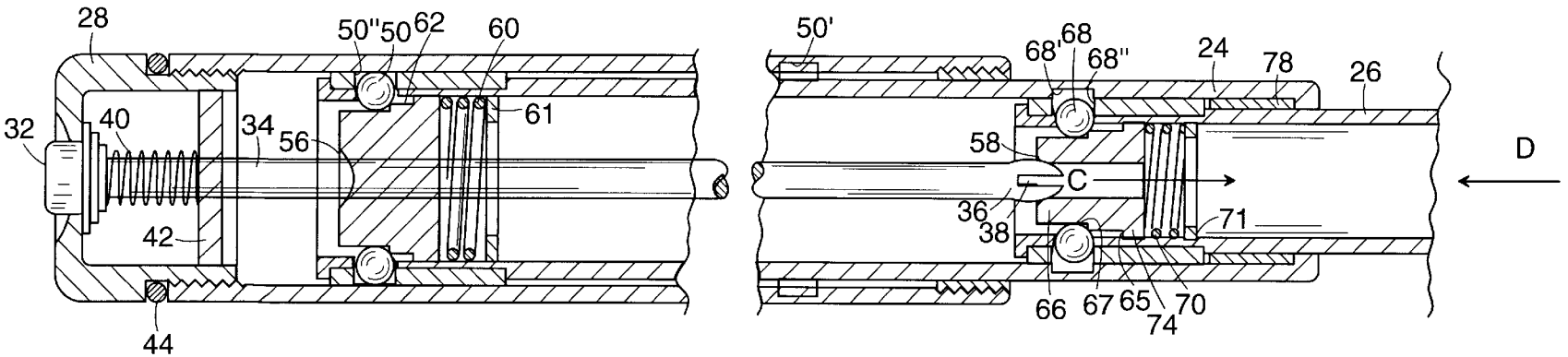
FIG. 6 is a sectional view similar to FIG. 5 with the smallest section also beginning to collapse into the intermediate section as its lock is moved in a direction to permit this to occur.

FIG. 6 illustrates the camming surface 36 engaging chamfered camming surface 58 of the second locking cam member 64, which results in the cam member 64 moving in the direction of arrow C. This in turn moves the locking cam member 64 such that the reduced diameter portion 66 underlies the ball bearings 68, allowing them to disengage from the groove 68' formed in tubular member 24. After the disengagement of ball bearings 68, the third tubular section 26 can collapse into the middle tubular section 24 in the direction of arrow D, resulting in the collapsed configuration shown in FIG. 3.

Figure 7:
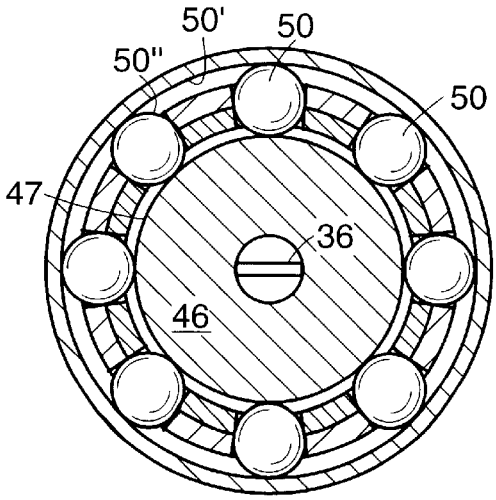
FIG. 7 is a sectional view taken along line 7—7 in FIG. 4.

FIG. 7 is a cross-sectional view of the first locking arrangement for maintaining the second tubular section 24 in an extended configuration vis-à-vis the first handle section 22, as shown in FIG. 4. The large diameter portion 47 of the locking cam member 46 abuts the ball bearings 50, the locking cam member 46 being biased by a spring 60 in the locking position as shown in the figure. Also shown is a central bore 54 of the locking cam member 46. The ball bearings 50 are urged against the interior surface of the tubular handle section 22, and into locking groove 50' formed on the interior wall of tubular section 22. When the baton is in the fully extended configuration, the camming portion 36 of the release rod 34 resides outside the locking cam member 46, as seen in FIG. 4.

Figure 8:
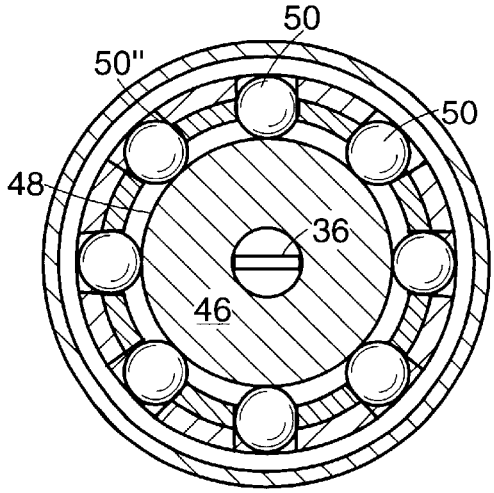
FIG. 8 is a sectional view taken along line 8—8 in FIG. 5.

FIG. 8 is a cross-sectional view of the first locking arrangement in a released state, as depicted in FIG. 5. The locking cam member 46 is shown positioned such that the reduced diameter portion 48 is underlying the ball bearings 50, under the influence of the camming portion 38 of the release rod 34 passing into the bore 54. As shown in FIGS. 3 and 4, the locking cam member 46 comprises a camming surface 56 to aid in the passing of the camming surface 36 of the release rod 34 into the bore 54. The ball bearings 50 are shown disengaged from the groove 50', allowing the sections of the baton to be collapsed. As the sections are moved into a collapsed configuration, the camming portion 36 of the release rod 34 radially collapses resiliently because of the notch 38, allowing the camming portion 36 of the release rod 34 to penetrate the first locking cam 46.

The depiction of the first locking mechanism of FIGS. 7 and 8 applies to the operation of the second locking mechanism. As set forth hereinabove, the initial release, that is the release of the first section 22 vis-à-vis the middle section, requires the operation of the button 32 to advance the release rod 34. The collapse of the inner section 26 into the middle section 24, however, only requires that the inner section 26 be pushed into the middle section 24 in the direction of arrow D as seen in FIG. 6.

As may be observed, the present invention provides a new and improved positive lock mechanism which uses an axial cam push baton positive lock mechanism which makes for easy use by the police officer by merely pushing a single button to effect the collapse of the three section baton. It is also clear from the above that the mechanism herein is also applicable to two section batons.

Although the invention has been shown and described with respect to exemplary embodiments thereof, various other changes, additions and omissions in the form and detail thereof may be made therein without departing from the spirit and scope of the invention.

What is claimed is:

1. A multi-stage positive lock tubular police baton comprising, in combination:

a tubular handle section;

a tubular middle section configured to telescopingly reciprocate within the handle section, having a first groove formed on an inner surface thereof and a first ball bearing receivable in the first groove;

a first locking cam member position within the tubular handle section, said cam member having a center bore with a first camming surface, a large diameter portion, a reduced diameter portion, and a second camming surface, the large diameter portion underlying the first ball bearing and biasing it outwardly into the first groove when the middle section is in a telescoped position with respect to the handle section, the reduced diameter portion underlying the first ball bearing and allowing the first ball bearing to move out of the first groove when the middle section moves from the telescoped position to a collapsed position;

a tubular inner section configured to telescopingly reciprocate within the middle section, having a second groove formed on an inner surface thereof and a second ball bearing receivable in the second groove;

a second locking cam member position within the tubular middle section, said cam member having a center bore with a first camming surface, a large diameter portion, a reduced diameter portion, and a second camming surface, the large diameter portion underlying the second ball bearing and biasing it outwardly into the second groove when the inner section is in a telescoped position with respect to the middle section, the reduced diameter portion underlying the second ball bearing and allowing it to move out of the second groove when the inner section moves from the telescoped position to a collapsed position; and a release rod extending axially through the handle, middle and inner sections, the release rod having a notch formed in one end thereof to allow the one end to radially resiliently collapse, and having a camming surface at the one end to engage the first camming surface of the first locking cam member and the first camming surface of the second locking cam member when the release rod is moved axially, the engagement of the camming surfaces causing the first and second ball bearings to be released from the first and second grooves, respectively.

2. The police baton of claim 1, further comprising a button in an end of the handle section and operably connected to the release rod such that depressing the button causes the camming surface of the release rod to engage the first camming surface of the first locking cam member.

3. The police baton of claim 2, further comprising a spring to bias the button outwardly from an end of the handle section.

4. The police baton of claim 1, wherein the first cam member is slidably disposed within the middle section.

5. The police baton of claim 1, wherein the first cam member is biased toward the handle section by a spring.

6. The police baton of claim 1, wherein the second cam member is slidably disposed within the inner section.

7. The police baton of claim 1, wherein the second cam member is biased toward the middle section by a spring.

8. The police baton of claim 1, further comprising a tip member comprised of an elastic or plastic coating.

9. The police baton of claim 1, wherein the handle section, middle section, and inner section are of steel or aluminum.

* * * * *